169-46 SR
4/21/87 XR 4,658,716

United States Patent [19]

Boissevain

[11] Patent Number: 4,658,716

[45] Date of Patent: Apr. 21, 1987

[54] INFRARED HEATING CALENDER ROLL CONTROLLER

[75] Inventor: Mathew G. Boissevain, Cupertino, Calif.

[73] Assignee: Measurex Corporation, Cupertino, Calif.

[21] Appl. No.: 722,834

[22] Filed: Apr. 12, 1985

[51] Int. Cl.[4] ..... B30B 15/34; B30B 3/04

[52] U.S. Cl. ..... 100/38; 100/47; 100/93 RP; 100/168; 100/162 B; 29/116 AD; 219/10.41; 219/354; 219/470; 34/41; 34/25; 169/5; 169/46; 169/54

[58] Field of Search ..... 100/93 RP, 38, 162 B, 100/47, 917, 168, 99; 219/10.41, 10.43, 10.57, 10.61 R, 10.71, 10.73, 388, 354, 469, 470, 471; 34/41, 48, 25, 4; 169/5, 43, 46, 54; 29/116 AD, 113 AD

[56] References Cited

U.S. PATENT DOCUMENTS

| | | | |
|---|---|---|---|
| 2,415,025 | 1/1947 | Grell et al. . | |
| 2,981,175 | 4/1961 | Goyette . | |
| 3,164,717 | 1/1965 | Kaufman | 219/388 |
| 3,177,799 | 4/1965 | Justus et al. . | |
| 3,203,678 | 8/1965 | Sawyer et al. . | |
| 3,359,643 | 12/1967 | Leibelt et al. | 34/25 |
| 3,413,915 | 12/1968 | Goodwin et al. . | |
| 3,438,088 | 4/1969 | Westbrook et al. . | |
| 3,448,808 | 6/1969 | Scofield et al. | 169/5 X |
| 3,456,582 | 7/1969 | McClenathan . | |
| 3,521,325 | 7/1970 | Schippers et al. . | |
| 3,556,000 | 1/1971 | Goodwin et al. . | |
| 3,702,912 | 11/1972 | Greenberger . | |
| 3,770,578 | 11/1973 | Spurrell . | |
| 3,772,492 | 11/1973 | Brogden et al. . | |
| 3,953,961 | 5/1976 | Harrap et al. | 169/46 X |
| 3,956,612 | 5/1976 | Ballard et al. | 219/388 X |
| 4,114,528 | 9/1978 | Walker . | |
| 4,384,514 | 5/1983 | Larive et al. . | |
| 4,425,489 | 1/1984 | Pav et al. . | |
| 4,573,402 | 3/1986 | Sharma et al. | 100/93 RP |

FOREIGN PATENT DOCUMENTS

| | | |
|---|---|---|
| 1143039 | 3/1983 | Canada . |
| 575567 | 4/1958 | Italy . |
| 67827A81 | 6/1981 | Italy . |
| 977098 | 12/1964 | United Kingdom . |

OTHER PUBLICATIONS

Pulp & Paper Magazine, Nov. 1984, pp. 54–55.
Pulp & Paper Magazine, Dec. 1984, p. 157.

*Primary Examiner*—Peter Feldman
*Attorney, Agent, or Firm*—Spensley Horn Jubas & Lubitz

[57] ABSTRACT

The present invention is directed toward a controller for controlling the local diameters of a temperature sensitive calender roll by selectively heating sections of a sheet of calenderable material with infrared lamps while the sheet is in contact with the calender roll or before the sheet contacts the roll. The calender roll is made of a material having at least one dimension which responds to changes in temperature. Therefore, thermal expansion of the roll, resulting from contact of the heated sheet with the roll surface, corrects local non-uniformities in the calender roll diameters. If the calender rolls unexpectedly stop or slow down so that the sheet of calenderable material becomes overexposed to infrared radiation, a fire detecting device detects and extinguishes the fire by turning off the infrared heating lamps and flooding the area around the lamps with a fire-extinguishing fluid.

10 Claims, 2 Drawing Figures

INFRARED HEATING CALENDER ROLL CONTROLLER

BACKGROUND OF THE INVENTION

The present invention relates to the field of calenders, and more particularly to devices for controlling the diameter of rolls used in calenders or analagous machines.

Pressing a material between two calender rolls can change the physical charateristics of the material. For example, calendering paper can change its density, thickness and surface features. Thus, the calendering process is frequently used in the manufacture of paper and other sheet materials where it is often desirable to change the density, thickness or surface features of the material.

A common problem associated with calendering is an uneven thickness of the sheet of calendered material. Localized variations in a variety of parameters affect the diameter of individual calender rolls and create variations in the spacing or "nip" between cooperating rolls. Variation in the nip across the width of a pair of calender rolls produces a sheet having non-uniform thickness. Thus, a more uniform thickness could be obtained if the local diameters of the calender rolls could be controlled.

If a calendar roll is made of a material that responds to changes in temperature, one may control local roll diameters by varying the temperature of selected cylindrical sections or "slices" of the roll. Previous devices use this principle by directing infrared heat radiation against the surface of slices of a rotating calender roll to control the local diameters of the roll. This infrared heating method, however, is inefficient since the absorptivity of the polished wrought iron surface of most calender rolls is very low, about 0.28. Therefore, instead of heating the calender roll, most of the infrared radiation directed against the roll is reflected. The present invention provides a more efficient means of utilizing infrared radiation to heat a calender roll.

Other types of calender roll control devices direct jets of hot or cold air against slices of a rotating calender roll to control its local diameters. Many of these devices blow hot air from a hot air plenum against slices of the calender roll to increase the local diameter of the roll and thus decrease the local thickness of the sheet of calendered material. Alternatively, when these devices release cold air from a cold air plenum against selected slices of the calender roll, those slices contract. This decreases the local roll diameter and increases the local thickness of the sheet of calendered material.

These air jet devices are subject to certain limitations and inefficiencies. For example, the nip control range is determined by the maximum and minimum temperatures of the air jets. The air in the hot air plenum is typically heated by waste steam from the facility power plant. However, waste steam supplied by the power plant generally has a maximum temperature of about 350° F. and inefficiencies in the heat exchange process further limit the maximum temperature of steam heated air to about 325° F. Examples of such devices are shown in U.S. Pat. No. 4,114,528 to Walker and U.S. Pat. No. 3,770,578 to Spurrell.

The calender roll control device of the present invention has a number of features which overcome many of the disadvantages of air jet control devices heretofore known. For example, the infrared heat lamps used by the present invention to heat the calender roll are capable of achieving higher temperatures than steam heated air. This higher temperature provides a greater nip control range. Additionally, the relatively low efficiency of heat transfer between the air jets and the calendar rolls results in a relatively slow response time and a limited ability to affect the roll diameters. The device of the present invention provides a more rapid and efficient means for heating the calender rolls with infrared radiation.

Another type of previously known calender roll control device uses magnetic fields to heat the calender roll. An example of this type of device is shown in U.S. Pat. No. 4,384,514 to Larive et al. In this type of device, the calendar roll is made of a conducting material and magnets are positioned close to the roll surface. As the rotating roll passes under the magnets, slices of the roll are heated by magnetic induction. The magnetic fields induce currents in the calender roll which dissipate their energy by heating the roll. However, because 50/60 Hz magnets have high magnetic forces which may bend the roll, 25 KHz alternating current electromagnets are generally used. Thus, workable magnetic induction calender roll control devices generally require a special alternating current power supply.

Furthermore, to achieve the greatest heating effect, the magnets generally should be positioned within about one-eight inch of the calender roll surface. However, placing the magnets this close to the calender roll may lead to damage when the sheet of calenderable material breaks. A broken sheet can wrap around the roll a sufficient number of times to build up a thick layer of calendered material on the roll. Once this layer becomes more than one-eight inch thick, the rotating calender roll can drive the material into the magnets with sufficient force to damage both the magnets and their supporting structure.

The device of the present invention also provides a number of advantages over magnetic induction calender roll control devices. For example, the infrared reflectors used in the present invention to direct infrared radiation from the infrared heat lamps toward the calender roll are generally positioned approximately two inches from the roll surface. This two inch between the reflectors and the calender roll greatly decreased the possibility of damage to the reflectors by contact with the calendered material. Additionally, the device of the present invention is generally less expensive and easier to service than magnetic induction devices since it does not require a special alternating current power supply.

The present invention thus provides a number of advantages over prior art calender roll control devices. These and other advantages will become apparent in the description which follows.

SUMMARY OF THE INVENTION

The present invention is directed toward a controller for controlling the local diameters of a temperature sensitive calender roll by selectively heating sections of a sheet of calenderable material while the sheet is in contact with the calender roll or before the sheet contacts the roll. The calender roll is made of a material having dimensions which respond to changes in temperature. Therefore, thermal expansion of the roll, resulting from contact of the heated sheet with the roll surface, corrects local nonuniformities in the calender roll diameters.

The invention typically comprises a plurality of infrared heat lamps dispersed along the length of the calender roll. Each lamp preferably has an infrared reflector associated with it. Each reflector may be positioned so that it directs the heat energy from the associated lamp toward a particular section of calenderable material while the material is in contact with the roll. The calenderable material usually has a higher absorptivity for infrared radiation than the calender roll which may be polished and highly reflective. Therefore, the material is rapidly heated by the infrared radiation from the heat lamp and it subsequently transfers this heat by contact to the calender roll.

Occasionally, pieces of the sheet of calenderable material break off of the sheet as it travels around and between the calender rolls. These pieces of material may contact the infrared heating elements and ignite. Also, the sheet may ignite if the calender rolls unexpectedly stop or slow down so that the sheet becomes overexposed to infrared radiation. However, when a fire occurs, a fire detecting device detects and extinguishes the fire by turning off the infrared lamps and flooding the area around the lamps with a fire-extinguishing gas such as carbon dioxide. A variety of well known types of fire-detecting devices capable of producing an electrical signal in response to a fire are usable with the present invention.

Alternatively, each infrared reflector may be positioned so that it directs the heat energy from an associated lamp toward a particular strip of calenderable material before the heated material contacts the calendar roll. The calenderable material then heats slices of the calendar roll by contact as the material winds around the temperature sensitive calendar roll. Since pieces of calenderable material are most likely to break off from the main sheet while it is being worked by the calendar rolls, this configuration minimizes the possibility of a fire.

In either configuration, a power control device, which may include a computer, controls the heating of each slice of the calender roll to maintain a uniform thickness of calendered material. A sensor measures the thickness of the calendered material at intervals along its width and generates signals corresponding to the measured thickness of the material. The signals from the thickness sensor are fed to the power control device which compares the measured thickness of the calendered material with a desired thickness and adjusts the amount of power supplied to each infrared heat lamp to thereby control the diameter of each slice of the temperature sensitive calender roll.

DETAILED DESCRIPTION OF THE PREFERRED EMBODIMENTS

Figure 1:
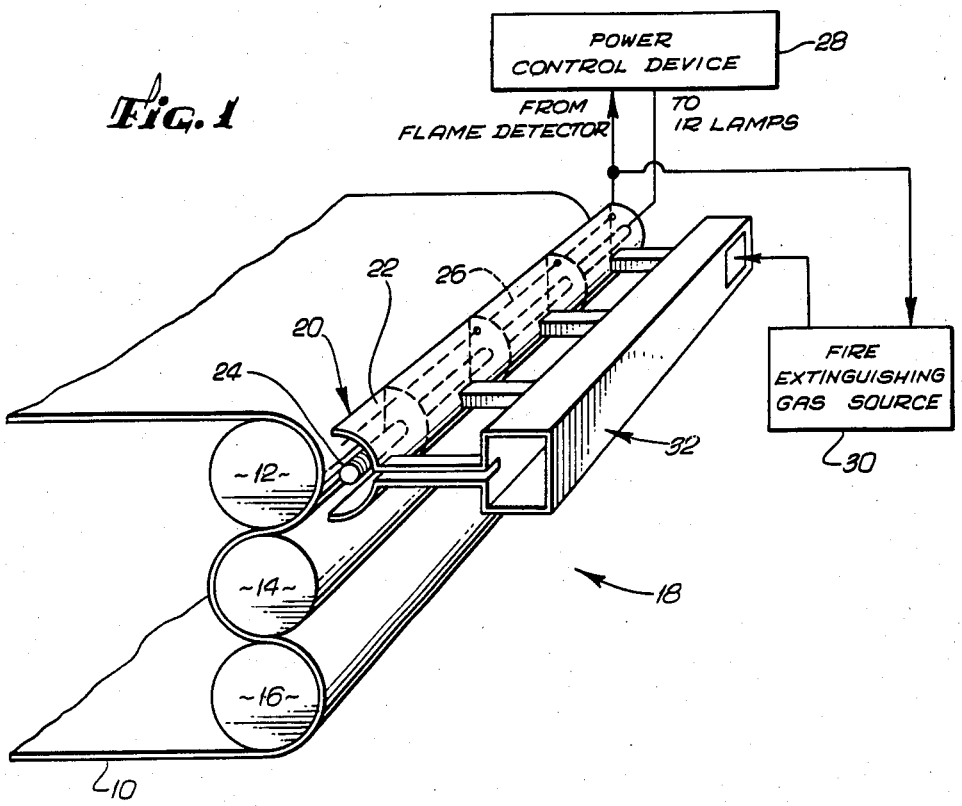
FIG. 1 is a cross-sectional perspective view of one embodiment of the present invention illustrating a series of infrared heat lamps irradiating a sheet of calenderable material and a manifold for directing fire-extinguishing gas to the volume around each heat lamp.

The first embodiment of the present invention is illustrated in FIG. 1. This illustration shows a calenderable material 10 such as paper winding through a stack of calender rolls 12, 14, 16 in a serpentine fashion. The calender roll control device 18 of the present invention is disposed adjacent the uppermost roll 12.

The invention comprises a plurality of infrared heat lamps 20 disposed at six inch intervals along the length of the calender roll 12. Infrared reflectors 22 substantially enclose a volume containing each infrared heating element 24 and the surface of the calenderable material 10 adjacent to each lamp 20. These reflectors direct the infrared radiation from each heat lamp 20 toward adjacent sections of the calenderable material 10. Since the material 10 is in contact with the roll 12, the heat radiation heats the material 10 adjacent to the lamp 20 which in turn heats a slice of the calender roll 12.

The roll 12 is made of a material, such as wrought iron, that has dimensions which respond to changes in temperature. Therefore, when a section of heated material 10 heats a slice of the roll 12 by contact, it expands. As the temperature of the heated slice of calender roll 12 increases, the thermally expanding roll 12 decreases the size of the nip formed between the heated slice of calender roll 12 and the adjacent cooperating roll 14. Thus, the heated slice of calender roll 12 produces a thinner section of calendered material 10.

Typically, the calendered material 10 will have a high absorptivity for infrared radiation. For example, paper absorbs 92–96% of impinging infrared radiation. In contrast, the surface of the polished wrought iron roll 10 absorbs only about 28% of impinging infrared radiation. The roll reflects the remaining 72% of the impinging radiation. Therefore, heating the roll 12 by contact with the heated material 10 is an efficient way to heat the calender roll 12. Furthermore, additional efficiency can be achieved by irradiating the calenderable material 10 while the material 10 is wrapped around the calender roll 12. In this configuration, the surface of the roll reradiates any infrared radiation which passes through the material 10 back toward the material 10 after absorbing some of the energy.

Occasionally, a piece of calendered material 10 will break off of the main sheet of material 10, contact an infrared heating element 24 and ignite. Alternatively, the sheet 10 may ignite if the calender rolls 12, 14, 16 unexpectedly stop or slow down so that the sheet 10 becomes overexposed to infrared radiation. When a fire occurs, a photocell-type fire detector 26 disposed within each infrared reflector 22 detects the fire and sends an electrical signal to the power control device 28 and to a source of compressed fire-extinguishing gas 30. Upon receipt of a fire signal from a fire detector 26, the power control device 28 shuts off the power to the infrared heat lamps 20 and the gas source 30 releases its supply of compressed gas into the manifold 32. The manifold 32 directs the gas toward the interior of each reflector 22, thus extinguishing the fire. Typically, the fireextinguishing gas is carbon dioxide which may be contained under pressure in a tank having an electronically controlled valve for releasing the gas into the manifold 32 upon command.

Figure 2:
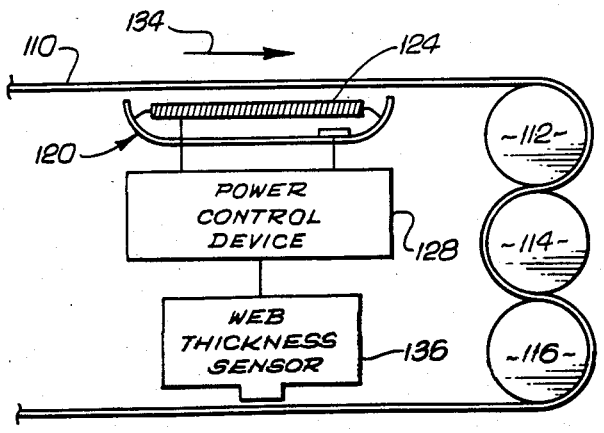
FIG. 2 is a cross-sectional view of another embodiment of the present invention illustrating infrared heat lamps disposed to heat calenderable material before it contacts the calender rolls, a thickness sensor for measuring the thickness of the calendered material and a device for controlling the amount of power supplied to each heat lamp in response to signals from the thickness sensor.

FIG. 2 is a cross-sectional view of another embodiment of the present invention. In this illustration, the calenderable material 110 travels in the direction of the arrow 134 from the infrared heat lamps 120 toward the uppermost calender roll 112. The heat lamps 120 are disposed so that they heat the sheet of calenderable material 110 before it contacts the calender roll 112. Since the sheet 110 is irradiated before it contacts the roll 112, the heat lamps 120 may be disposed lengthwise along the direction of travel of the sheet 110. The longer exposure time resulting from this configuration improves the heat transfer to the material 110 and thus improves the performance of the device.

The sheet of calenderable material 110 is most likely to break as it winds through the stack of calender rolls 112, 114, 116. A piece of the sheet 110 is most likely to contact an infrared heating element 124 and ignite when the sheet 110 breaks Thus, positioning the infrared lamp 120 so that it heats the sheet 110 before the sheet 110 contacts the calender roll 112, as shown in FIG. 2, minimizes the possibility of fire.

During the operation of the invention, a sensor 136 measures the thickness of the sheet 110 across its width and produces a signal corresponding to the measured thickness of each section of the sheet 110. These signals are fed to a computerized power controlling device 128 which compares the measured thickness of the sheet of calendered material 110 with a desired thickness and adjusts the power supplied to the heating elements 124 of each infrared heat lamp 120 to obtain a sheet 110 having the desired uniform thickness. This thickness sensor 136 and computerized control device 128 are also usable with the embodiment of the invention illustrated in FIG. 1. An example of a sensor controlled calender roll control device is shown in U.S. Pat. No. 4,114,528 to Walker.

Depending upon the degree of deviation of the calendered sheet 110 from the desired thickness, the power control device 128 supplies more or less power to the infrared heating elements 124 adjacent those slices of the calender roll 112 having diameters that are to be adjusted The slices of calender roll 112 producing too thick a sheet 110 are heated by energizing the heating elements 124 in an adjacent infrared heat lamp 120. As the amount of power supplied to the heating elements 124 increases, more infrared radiation impinges on the sheet of calenderable material 110 and more thermal expansion of the calender roll 112 occurs.

Alternatively, when the sensing device 136 detects a thin sheet section, the computerized power controlling device 128 directs less power to the adjacent heating elements 124 or turns these heating elements 124 completely off. As the power to the heating elements 124 decreases, ambient air cools the adjacent slices of calender roll 110. The cooling slices of calender roll 112 contract, thereby increasing the local nip spacing and producing a thicker section of calendered sheet 110.

Two preferred embodiments of the present invention have been described. Nevertheless, it is understood that one may make various modifications without departing from the spirit and scope of the invention. For example, instead of continuously varying the level of power to the heat lamps, the power may be switched on and off for varying percentages of a duty cycle. Additionally, the infrared heat lamps need not be placed at six inch intervals. Instead, these heat lamps can be positioned at greater or lesser intervals, depending upon the particular circumstances and the amount of control desired. Thus, the invention is not limited to the embodiments described herein.

I claim:

1. A calender roll control system of a type which uses infrared heat radiation to control the diameter of a calender roll and thereby control the thickness of a sheet of calenderable material, the system comprising:

a first calender roll having a diameter which responds to changes in temperature;

at least one cooperating second calender roll adjacent and substantially parallel to the first calender roll;

a sheet of calenderable material pressed between the first and second calender rolls, wherein a portion of said sheet is wrapped partially around the first roll so that the wrapped portion of the sheet contacts the surface of the first roll;

a plurality of infrared radiation heat lamps, said heat lamps being disposed at intervals along the axial direction of the first roll and also being directed at the poriton of the sheet which is wrapped around the first roll, so that the infrared radiation from the heat lamps directly heats the wrapped portion of the sheet of calenderable material which portion is in contact with said first roll and the wrapped portion of the sheet heats, by contact, the temperature responsive first calender roll; and power control means for selectively controlling the amount of power supplied to each of the heat lamps.

2. A calender roll control system as in claim 1, further comprising:

a manifold for distributing fire-extinguishing fluid to the sheet of calenderable material where said sheet is heated by infrared radiation; and supply means for supplying fire-extinguishing fluid to the manifold.

3. A calender roll control system as in claim 2, further comprising:

a fire detector for detecting combustion of the calenderable material and producing a signal in response thereto, the fire detector being located near the portion of the sheet which is directly heated by the heat lamps and wherein the fire detector is in communication with the supply means so that the signal from the fire detector causes the supply means to release fire-extinguishing fluid into the manifold.

4. A calender roll control system as in claim 3, wherein the fire detector is also in communication with the power control means so that the signal from the fire detector causes the power control means to turn off the heat lamps.

5. A calender roll control system as in claim 1, wherein the power control means comprises:

a thickness sensor for measuring the thickness of the sheet of calenderable material at a plurality of locations across the width of the sheet and producing signals in response to the measured thicknesses of the calenderable material at said locations; and a power control device for selectively controlling the amount of power supplied to each of the infrared heat lamps in response to the signals from the thickness sensor.

6. A calender roll control system of a type which uses infrared heat radiation to control the diameter of a calender roll and thereby control the thickness of a sheet of calenderable material, the system comprising:

a first calender roll having a diameter which responds to changes in temperature;

at least one cooperating second calender roll adajcent and substantially parallel to the first calender roll;

a sheet of calenderable material pressed between the first and second calender rolls, wherein a portion of said sheet is wrapped partially around the first roll so that the wrapped portion of the sheet contacts the surface of the first roll;

a plurality of infrared radiation heat lamps, said heat lamps being disposed at intervals along the axial direction of the first roll and also being directed at the portion of the sheet which is wrapped around the first roll, so that infrared radiation from the heat lamps directly heats the wrapped portion of the sheet of calenderable material and the heated wrapped portion of the sheet heats the first calender roll by contact;

power control means for selectively controlling the amount of power supplied to each of the heat lamps;

enclosing means for substantially enclosing a volume containing the heat lamps and the portion of the sheet of calenderable material which is in contact with the surface of the first roll;

a manifold in flow communication with the enclosing means; and supplying means for supplying fire-extinguishing fluid to the manifold.

7. A calender roll control system as in claim 6, wherein the power control means comprises:

a thickness sensor for measuring the thickness of the sheet of calendered material at a plurality of locations across the width of the sheet and producing signals in response to the measured thicknesses of the calendered material at said locations; and a power control device for selectively controlling the amount of power supplied to each of the infrared heat lamps in response to the signals from the thickness sensor.

8. A method of controlling with infrared heat radiation the diameter of a calender roll and thereby controlling the thickness of a sheet of calenderable material, the method comprising the steps of:

providing a calender roll having a diameter which responds to changes in temperature;

providing a surface adajcent to the surface of the calender roll;

pressing a sheet of calenderable material between the calender roll and the adjacent surface;

wrapping a portion of the sheet partially around the calender roll so that the wrapped portion of the sheet contacts the surface of the roll;

heating the portion of the sheet of calenderable material which is wrapped around the roll with infrared radiation while the wrapped portion of the sheet is in contact with the temperature responsive calender roll, so that the wrapped portion of the sheet transfers the heat, by conduction, to the roll;

measuring the thickness of the sheet of calenderable material at intervals along the width of the sheet;

comparing the measured thicknesses of the sheet of calenderable material with a desired thickness; and controlling the amount of infrared radiation heating the sheet of calenderable material at each of said intrevals based upon differences between the measured thickness and the desired thickness of the sheet.

9. A method as defined in claim 8, further comprising the step of:

directing fire-extinguishing fluid at the calenderable material.

10. A method of controlling with infrared heat radiation the diameter of a calender roll and thereby controlling the thickness of a sheet of calenderable material, the method comprising the steps of:

providing a calender roll having a diameter which response to changes in temperature;

providing a surface adjacent to the surface of the calender roll;

pressing a sheet of calenderable material between the calender roll and the adjacent surface;

wrapping a portion of the sheet partially around the calender roll so that the wrapped portion of the sheet contacts the surface of the roll;

heating the portion of the sheet of calenderable material which is wrapped around the roll with infrared radiation to a temperature of between approximately 190° F. and temperature just below the kindling point of the material;

measuring the thickness of the calendered sheet of material at intervals along the width of the sheet;

comparing the measured thicknesses of the sheet with a desired thickness; and controlling the amount of infrared radiation heating the sheet at each of asid intervals based upon differences between the measured thicknesses and the desired thickness of the sheet.

* * * * *